US010343821B2

(12) United States Patent
Lemmons et al.

(10) Patent No.: US 10,343,821 B2
(45) **Date of Patent: *Jul. 9, 2019**

(54) RECLOSABLE LABEL

(71) Applicant: Gateway Packaging Company, Granite City, IL (US)

(72) Inventors: Kevin Lemmons, Jackson, MO (US); Brian Schiermeier, Florissant, MO (US)

(73) Assignee: GATEWAY PACKAGING COMPANY LLC, White House, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/288,300

(22) Filed: Oct. 7, 2016

(65) Prior Publication Data

US 2017/0021974 A1 Jan. 26, 2017

Related U.S. Application Data

(63) Continuation of application No. 14/630,293, filed on Feb. 24, 2015, now Pat. No. 9,475,615.

(51) Int. Cl.
*B65D 33/16* (2006.01)
*B65D 33/34* (2006.01)
*B65D 75/58* (2006.01)

(52) U.S. Cl.
CPC ..... *B65D 33/1691* (2013.01); *B65D 33/34* (2013.01); *B65D 75/5838* (2013.01); *B65D 2101/00* (2013.01)

(58) Field of Classification Search
CPC ..... B65D 75/5838; B65D 2101/0084; B65D 2101/0092; B65D 33/1691; B65D 33/34
(Continued)

(56) References Cited

U.S. PATENT DOCUMENTS 3,329,331 A * 7/1967 Morgan ..... B65D 75/26 229/125.09
4,735,335 A * 4/1988 Torterotot ..... B32B 15/08 220/260

(Continued)

OTHER PUBLICATIONS

Anne Marie Mohan, "Walkers Shortbread stays fresh in resealable pouch", Packaging World, allegedly published on Oct. 4, 2012, PMMI Media Group.

(Continued)

*Primary Examiner* — Jes F Pascua
(74) *Attorney, Agent, or Firm* — McLane Middleton, Professional Association

(57) ABSTRACT

A resealable label is disclosed, the label having a top layer and a bottom layer. The top layer may be one or more ply, and the bottom layer may be one or more ply. The top layer is adhered to the bottom layer via an adhesive layer therebetween. The bottom layer includes a concave perforation, the concave perforation having a line defined by endpoints of the concave perforation. The label further includes a layer of deadener between the label layers, the deadener being on the convex side of the perforation, and terminating at the line, the line extending to opposing edges of the label, where the deadener is at least some distance away from the perforation such that the deadener and the perforation do not abut. The label may further have a layer of adhesive on the bottom layer for adhering the label to a surface. The disclosure further includes a reclosure system that includes the resealable label and an inner label for mounting on a surface.

10 Claims, 10 Drawing Sheets

(58) Field of Classification Search
USPC ..... 383/5, 203, 204, 210, 211, 207–209
See application file for complete search history.

(56) References Cited

U.S. PATENT DOCUMENTS

| | | | | |
|---|---|---|---|---|
| 4,874,096 | A | 10/1989 | Tessera-Chisea | |
| 4,896,755 | A | 1/1990 | Boeckmann | |
| 4,896,775 | A * | 1/1990 | Boeckmann | B65D 77/30 206/557 |
| 5,855,435 | A | 1/1999 | Chisea | |
| 5,873,483 | A * | 2/1999 | Gortz | B65D 77/2056 206/469 |
| 6,589,622 | B1 | 7/2003 | Scott | |
| 6,767,604 | B2 | 7/2004 | Muir, Jr. et al. | |
| 7,228,968 | B1 | 6/2007 | Burgess | |
| 7,600,641 | B2 | 10/2009 | Burgess | |
| 7,681,732 | B2 * | 3/2010 | Moehlenbrock | B32B 7/12 206/459.1 |
| 7,717,620 | B2 | 5/2010 | Herbert et al. | |
| 7,842,365 | B2 | 11/2010 | Riggs | |
| 8,114,451 | B2 * | 2/2012 | Sierra-Gomez | B65D 75/5838 206/459.5 |
| 8,181,783 | B2 | 5/2012 | Kakura et al. | |
| 8,333,511 | B2 | 12/2012 | Rutzinger et al. | |
| 8,407,792 | B2 | 3/2013 | Gassoway | |
| 8,551,588 | B2 * | 10/2013 | Daffner | B65D 77/2056 428/35.2 |
| 8,889,205 | B2 | 11/2014 | Sierra-Gomez et al. | |
| 9,187,228 | B2 | 11/2015 | Vogt et al. | |
| 9,475,615 | B2 * | 10/2016 | Schiermeier | B65D 33/1691 |
| 2009/0127281 | A1 | 5/2009 | Hickey | |
| 2010/0172604 | A1 * | 7/2010 | Andersson | B65D 75/366 383/211 |
| 2010/0278454 | A1 * | 11/2010 | Huffer | B65D 75/5838 383/5 |
| 2012/0070105 | A1 | 3/2012 | Abel | |
| 2014/0000219 | A1 | 1/2014 | Pezzoli | |
| 2014/0079343 | A1 * | 3/2014 | Lyzenga | B65B 61/182 383/203 |
| 2015/0151885 | A1 * | 6/2015 | Nakano | B65D 75/5838 220/266 |
| 2018/0099786 | A1 | 4/2018 | Abuaita et al. | |

OTHER PUBLICATIONS

Published online: http://www.packworld.com/package-feature/reclosability/walkers-shortbread-stays-fresh-resealable-pouch.

* cited by examiner

RECLOSABLE LABEL

PRIORITY CLAIM

This application is a continuation of and claims priority to co-pending U.S. patent application Ser. No. 14/630,293, filed on Feb. 24, 2015.

FIELD OF THE DISCLOSURE

An apparatus and system for resealing bags is disclosed, specifically a multi-layered label that may be adhered to the exterior of a bag and allow for ready resealable access to the contents therein.

BACKGROUND

The statements in this section merely provide background information related to the disclosure and do not necessarily constitute prior art.

Many types of food products are packaged and sold to consumers in some form of bag, including multi-layered bags that contain at least one kraft paper layer. Grease or other oils or elements in some food products, particularly pet foods, may break down kraft paper. This breakdown can result in an obviously undesirable loss of bag integrity and/or failure of the bag.

Resealability of food product bags is a desirable feature, as air can cause spoilage of the food product(s) contained therein. Many types of resealable mechanisms exist, including plastic zipper strips that mate to form a resealable closure. These zipper strips can be expensive and add significant additional manufacturing steps.

There exists a need in the art for a new resealable mechanism that can be used on bags, including those that contain at least one paper layer.

SUMMARY

This section provides a general summary of the disclosure, and is not intended to provide a comprehensive disclosure of its full scope or all of its features.

A system for creating a resealable seal on a bag is disclosed. More specifically, a label is disclosed that may be adhered to the exterior of a bag, including a multi-layered bag containing at least one paper layer, where the label includes a resealable aperture. This label may be used in conjunction with a second interior label, and a perforation of the bag to create a unique resealable mechanism, one that prevents the interior food product from making contact with any paper layer of a multi-layered bag upon which it has been installed. A method of applying this system and label is disclosed.

Further areas of applicability will become apparent from the description provided herein. The description and specific examples in this summary are intended for purposes of illustration only and are not intended to limit the scope of the present disclosure.

BRIEF DESCRIPTION OF THE FIGURES

The drawings described herein are for illustrative purposes only of selected embodiments and not all possible implementations, and are not intended to limit the scope of the present disclosure.

Figure 1:
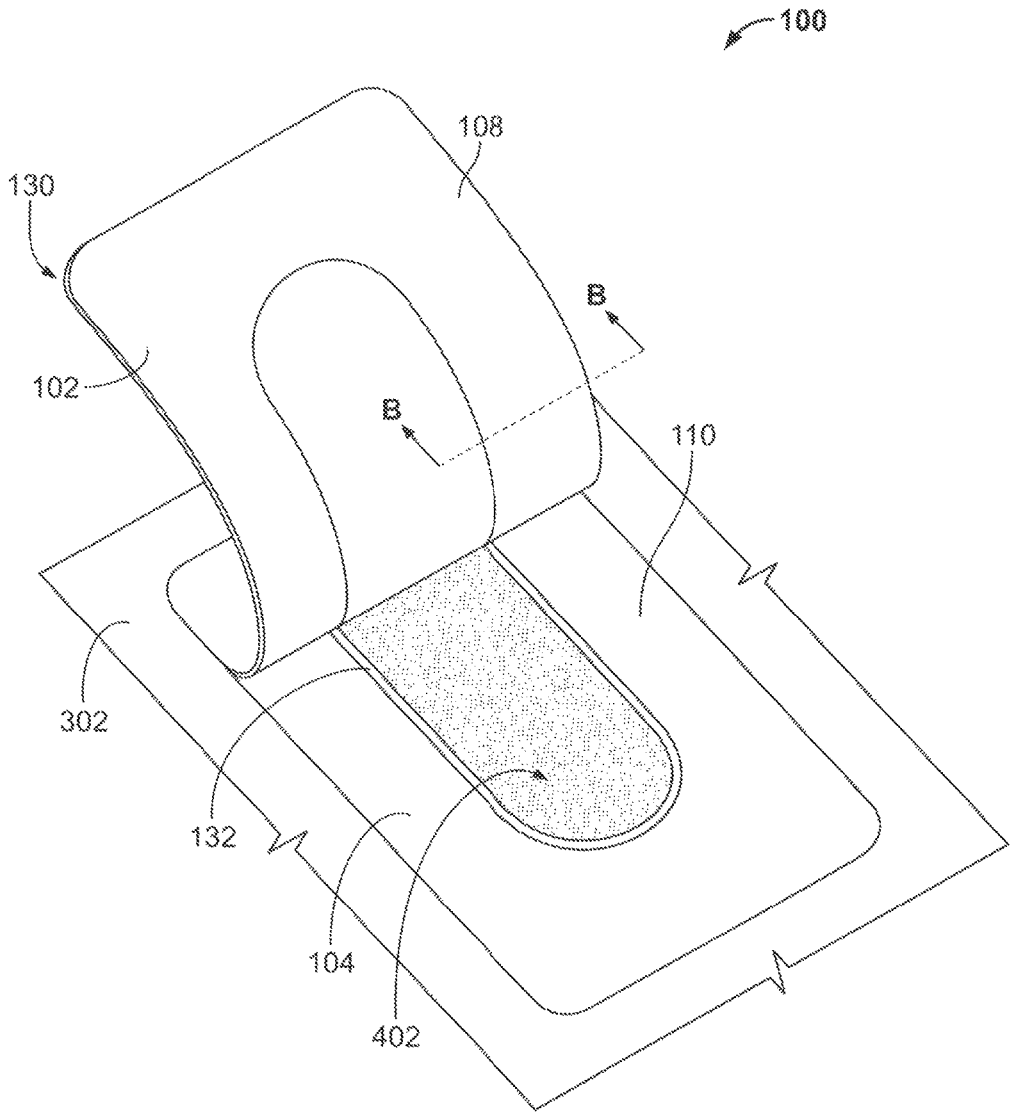
FIG. 1 shows a perspective view of a portion of a panel of a bag wall, the panel having an embodiment of a resealable label adhered thereto, the label pulled back in an open position to grant access to the inside of the bag.

The various embodiments of FIGS. 14 through 17 and all others are embraced within the scope of this disclosure.

Corresponding reference numerals indicate corresponding parts throughout the several views of the drawings.

DETAILED DESCRIPTION

The following description of various embodiments is merely exemplary in nature and is in no way intended to limit the invention, its application, or its uses. Areas of applicability will become apparent from the description provided herein.

A resealable label is disclosed, the label having a top layer and a bottom layer. The label has edges that make up a perimeter that define a shape of the label. The top layer may be one or more ply, and the bottom layer may be one or more ply. The top layer is adhered to the bottom layer via an adhesive layer therebetween. The bottom layer includes a concave perforation, the concave perforation having a line defined by endpoints of the concave perforation, the line extending beyond the endpoints and terminating at edges of the label.

The label further includes a layer of deadener between the label layers, the deadener being on the convex side of the perforation, and terminating at the line, the line extending to opposing edges of the label, where the deadener is at least some distance away from the perforation such that the deadener and the perforation do not abut.

The label may further have a layer of adhesive on the bottom layer for adhering the label to a surface.

Turning to the figures, the features of the resealable label may be more clearly illustrated.

FIG. 1 shows a perspective view of a portion of a panel of a bag wall 302, the panel having an embodiment of a resealable label 100 adhered thereto, the label pulled back in an open position to grant access to the inside of the bag 402.

In the view of FIG. 1, the top layer 102 of the resealable layer has been opened and pulled back, revealing a portion of the bottom layer 104. The adhesive layer 108 between the top and bottom layers remains adhered to the exposed portion of the top layer, while the deadener 110 on the bottom layer prevents the adhesive from more permanently sticking the two label layers together, thereby permitting the resealable opening of the label as seen in FIG. 1. The reclosure region 132 of the label is also visible in FIG. 1, in an area where no deadener has been applied to the bottom layer 104, thereby providing a secure seal between the layers of the label. To open the label, one may pull on the corner 130 of the top layer of the resealable label.

Figure 2:
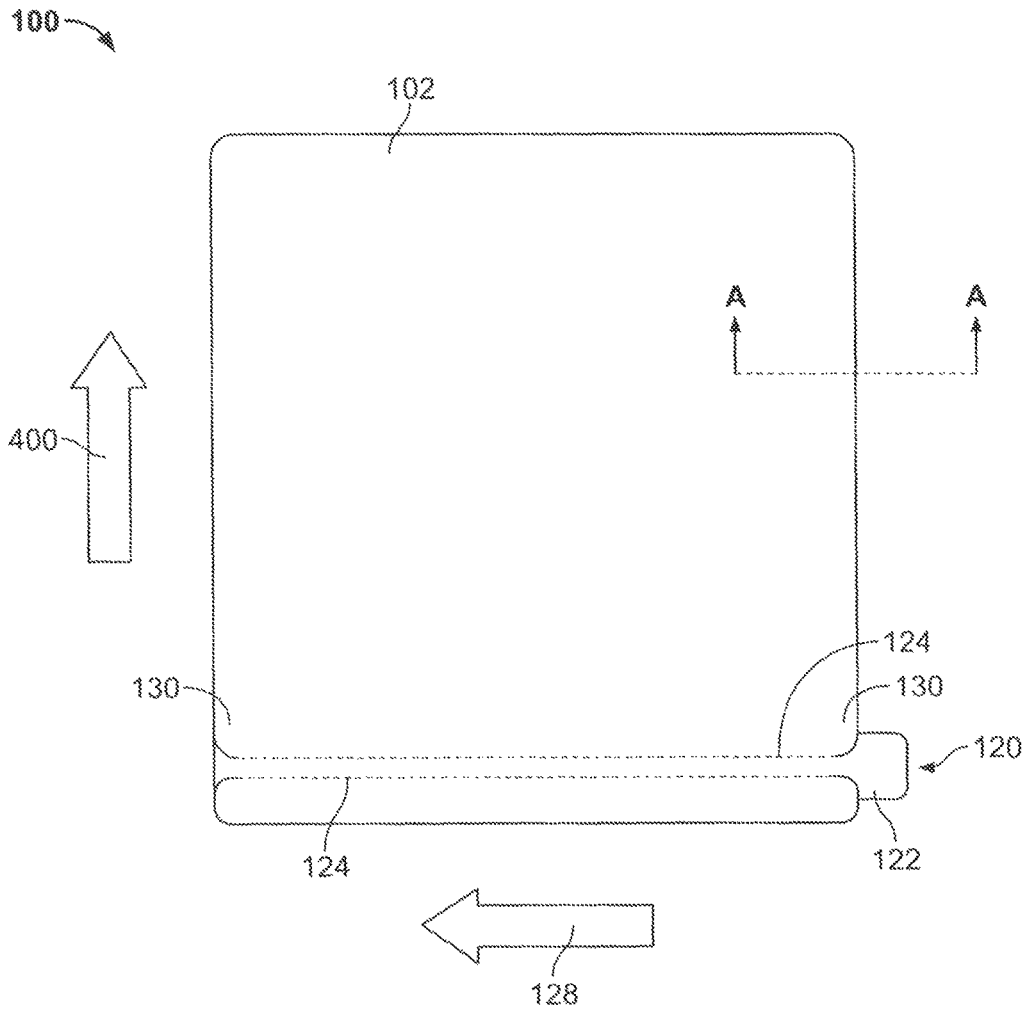
FIG. 2 shows a top view of an embodiment of a resealable label, this embodiment including a tamper evident feature.
Figure 3:
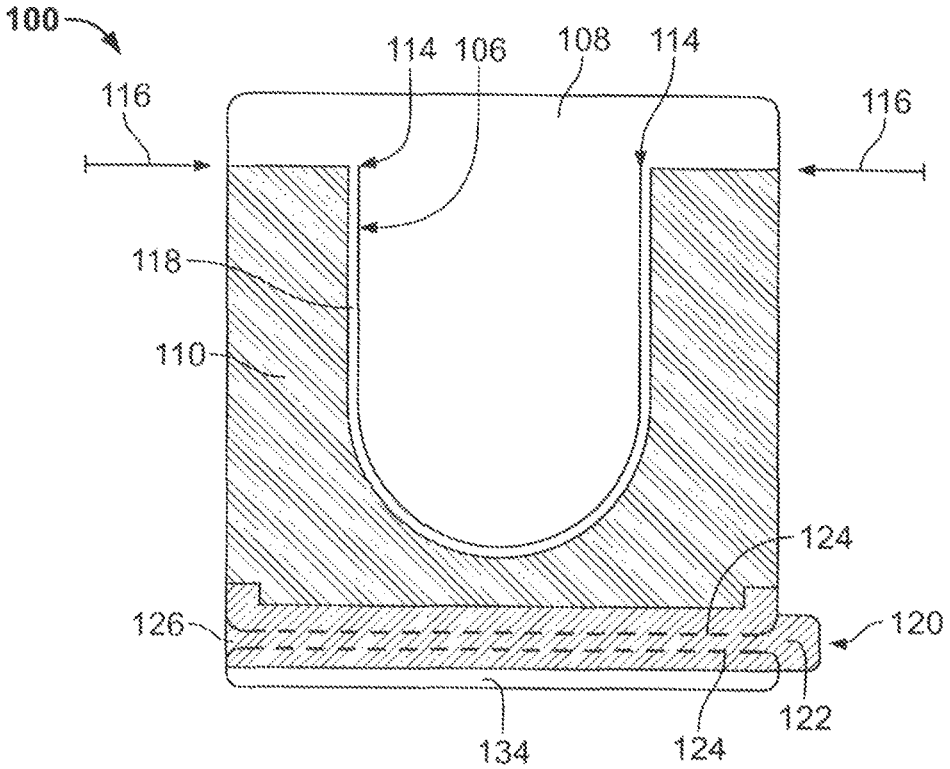
FIG. 3 shows regions of adhesive and deadener between the layers of the embodiment of a resealable label of FIG. 2.

FIG. 2 shows a top view of an embodiment of a resealable label 100, this embodiment including a tamper evident feature 120. Any variety of appropriate tamper evident apparatus may be used with the disclosed resealable label, and this particular embodiment seen in the figures is non-limiting. In FIG. 2, only the top layer 102 is visible, obscuring the view of the bottom layer or the adhesive layer. FIGS. 2 and 3, viewed together, provide details on this particular embodiment of the tamper evident apparatus.

The embodiment of the tamper evident feature 120 seen in FIG. 2 includes a tab 122 and two linear substantially parallel series of incomplete perforations 124 of the top layer 102 of the label 100. The pull tab 122 is a protrusion of the top layer at an edge of the label generally centered at adjacent terminating ends of the series of perforations 124. In operation, a user of the label may grab a hold of the tab and pull it in a tamper evident applications opening direction 128. In so doing, the user will remove the portion of the top layer 102 between the two linear substantially parallel series of incomplete perforations 124. Once that portion of the top layer has been so removed, the user may then grab a hold of the corner of the resealable label 130 and pull the top layer back in an opening direction 400. The result of this series of steps is the image seen in FIG. 1 of an opened label that may be resealed.

FIG. 3 shows regions of adhesive 108 and deadener 110 between the layers of the embodiment of a resealable label 100 of FIG. 2, as well as the perforation 106 of the bottom layer. In this embodiment, the resealable layer has both a top layer and a bottom layer, as in FIG. 1. The perforation 106 is generally concave in shape and, as will be seen in subsequent figures, may be in a variety of shapes. The perforation 106 resides on the bottom layer of the label 100. In this embodiment, the perforation is in a U-shape. A line 116 may be imagined thereon having the two endpoints 114 of the perforation. This line 116 marks the furthest back that the top layer may be pulled to open the resealable label 100, as described in the preceding paragraph and as seen in FIG. 1, for example.

The region of deadener 110 between the labels can generally be defined as bound by the line 116, the outer edges of the label, the tamper evident apparatus 120, and the perforation 106, where some distance 118 exists between the perforation and the labels. Where the deadener 110 meets the tamper evident apparatus 120, the deadener between the layers may terminate at another abutting layer of deadener in the same plane that is a part of the tamper evident apparatus. Alternatively, the deadener layer 110 may be applied in concert with the tamper evident deadener region 126. In another embodiment, the tamper evident deadener region 126 may be applied in addition to the deadener layer 110 such that the tamper evident deadener region is actually a double application of deadener.

Referring to the tamper evident apparatus 120 as seen in FIG. 3, the series of perforations 124 are in this embodiment substantially parallel to the line 116 defined by endpoints 114 of the concave perforation 106. The series of perforations 124 reside a distance away from and on the same side as the convex end of the concave perforation 106. Beyond the tamper evident deadener region 126 is the tamper evident apparatus non-deadener region 134, which is essentially a layer of adhesive that keeps a portion of the top layer adhered to the bottom layer after the opening of the tamper evident apparatus 120.

The tamper evident deadener region 126 extends out to the tab 122 to ease in the lifting of the tab and tearing of the perforations 124 to open the label.

Figure 4:
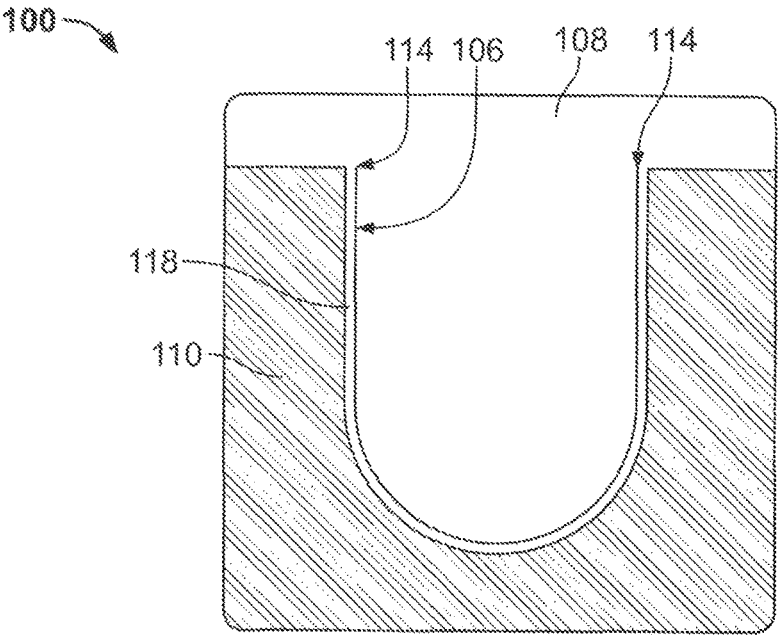
FIG. 4 shows regions of adhesive and deadener between the layers of an embodiment of a resealable label, this embodiment not including a tamper evident feature.

FIG. 4 is a similar view to that of FIG. 3, except that this particular label does not have a tamper evident apparatus. The regions of adhesive 108 and deadener 110 between the layers of an embodiment of a resealable label are seen in this embodiment, one not including a tamper evident feature. In this embodiment, the label 100 again has a concave U-shaped perforation 106, the perforation having two endpoints 114. The perforation resides some distance 118 from the edge of the deadener 110.

Figure 5:
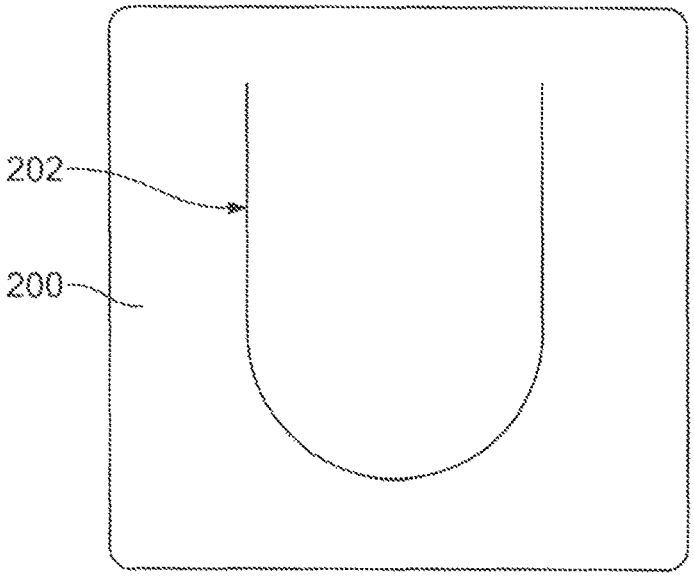
FIG. 5 shows a top view of an embodiment of an inner label, for use in conjunction with a resealable label in some applications.

FIG. 5 shows a top view of an embodiment of an inner label 200, for use in conjunction with a resealable label in some applications. The inner label has a perforation 202 that is complementary in shape to the perforation of the bottom layer of the resealable label seen in the prior figures. Where an inner label is present, the perforations 106 and 202 should be complementary in shape, though not necessarily in the same dimensions, as will be seen in subsequent figures. The outer edges of the inner label 200 may be the same as that of the resealable label 100, though this is not required. In the figures, both the resealable label 100 and the inner label 200 are both a square with rounded edges.

Figure 6:
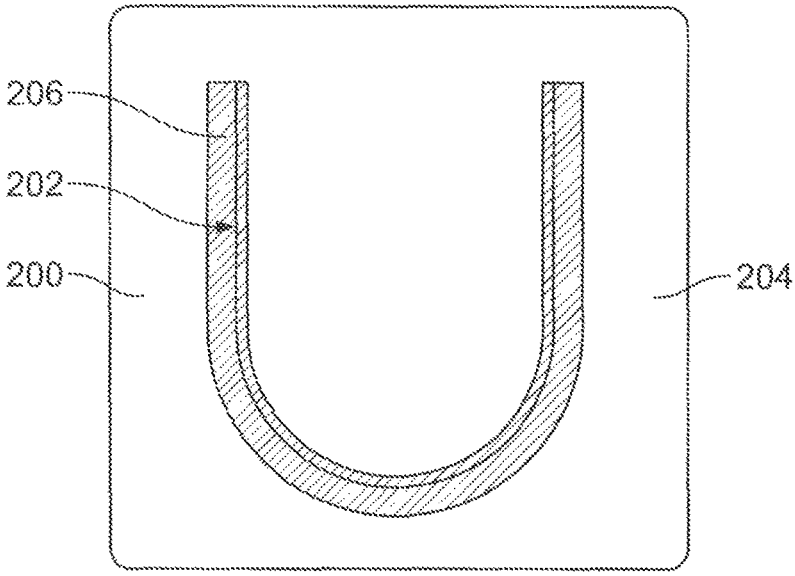
FIG. 6 shows the embodiment of the inner label of FIG. 5, with additional details showing regions of adhesive and deadener.

FIG. 6 shows the embodiment of the inner label 200 of FIG. 5, with additional details showing regions of adhesive 204 and deadener 206, relative to the perforation of the inner label 202.

Figure 7:
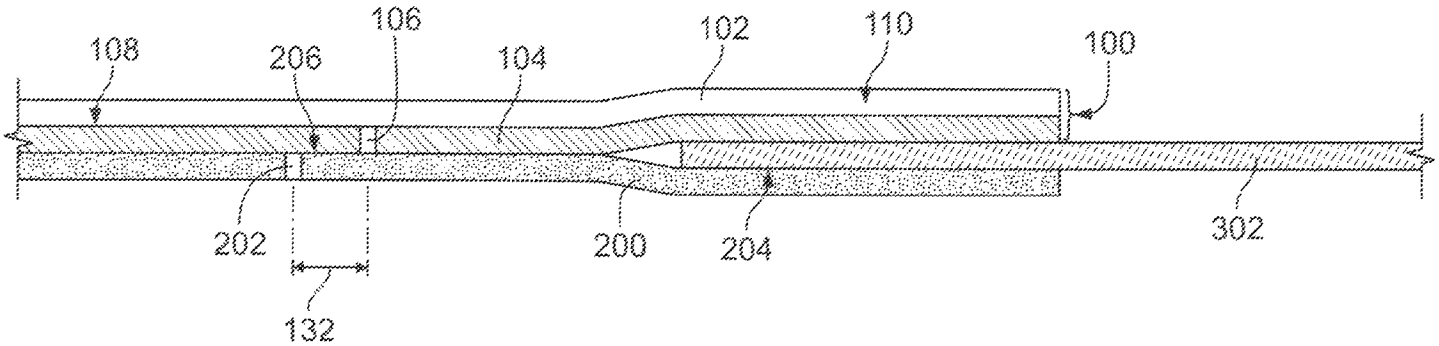
FIG. 7 shows the cross-sectional view along line A-A of FIG. 2, where both a resealable label and an inner label have been adhered to a panel of a bag wall.
Figure 8:
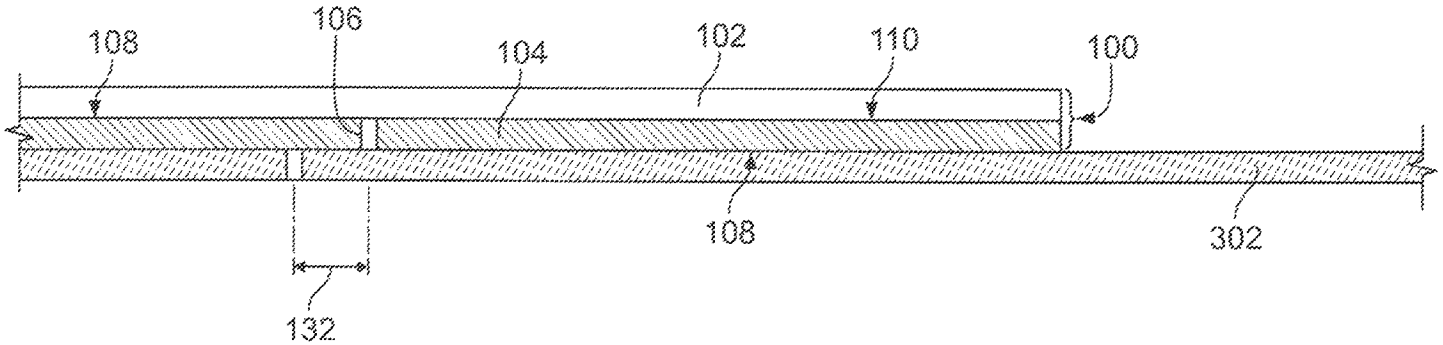
FIG. 8 shows the cross-sectional view along line A-A of FIG. 2, where a resealable label has been adhered to a panel of a bag wall.
Figure 9:
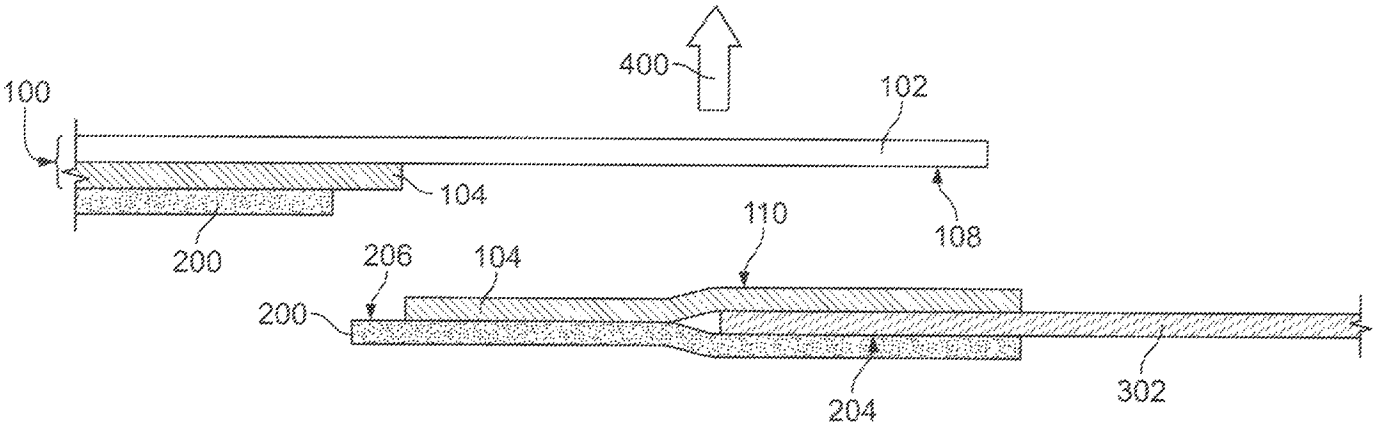
FIG. 9 shows the cross-sectional view along line B-B of FIG. 1, where both a resealable label and an inner label have been adhered to a panel of a bag wall.
Figure 10:
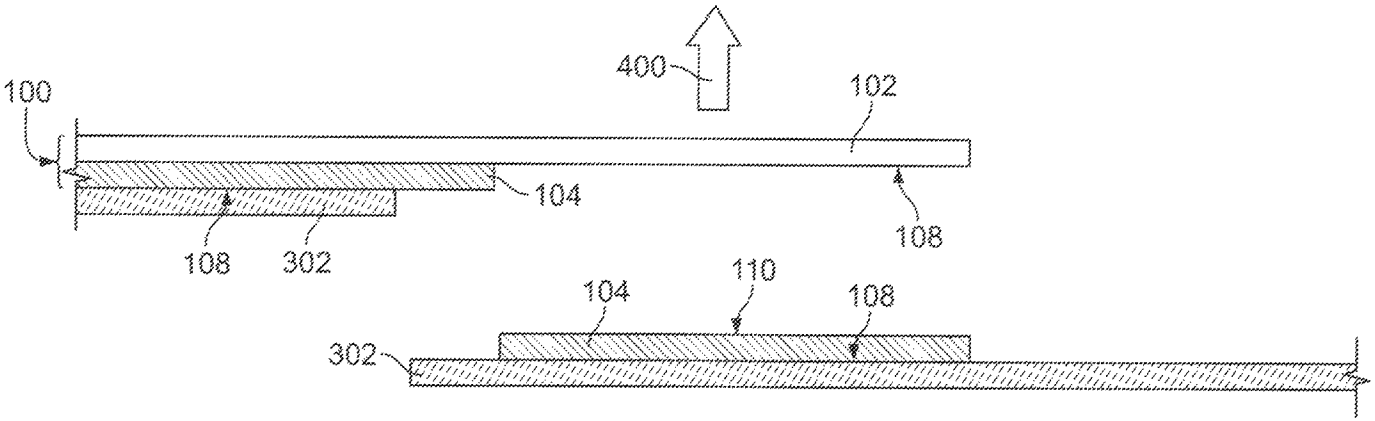
FIG. 10 shows the cross-sectional view along line B-B of FIG. 1, where a resealable label has been adhered to a panel of a bag wall.
Figure 11:
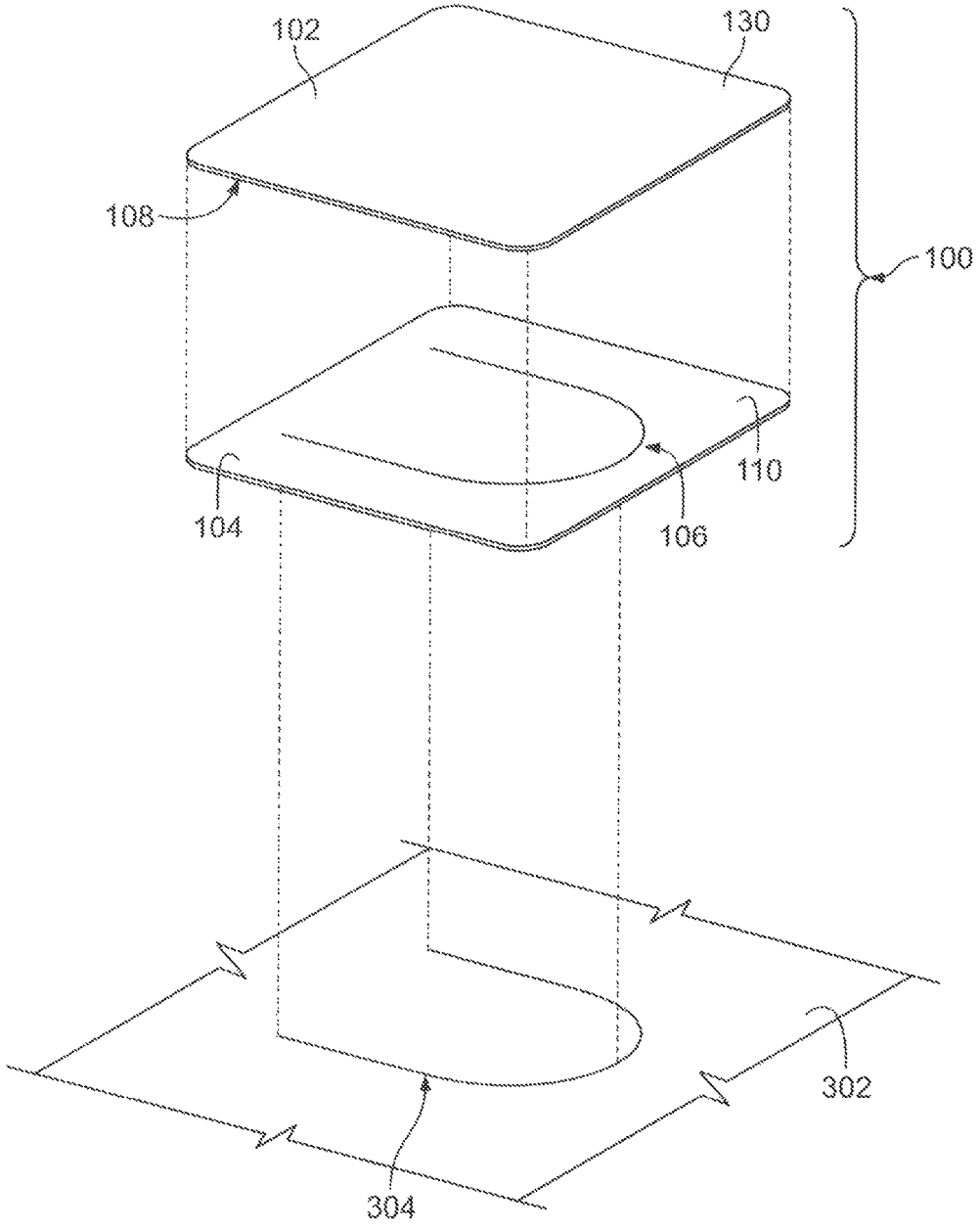
FIG. 11 shows an exploded perspective view of an embodiment of a resealable label and its layers as applied to the exterior of a panel of a bag wall that has been perforated with a tombstone-shaped cut.
Figure 12:
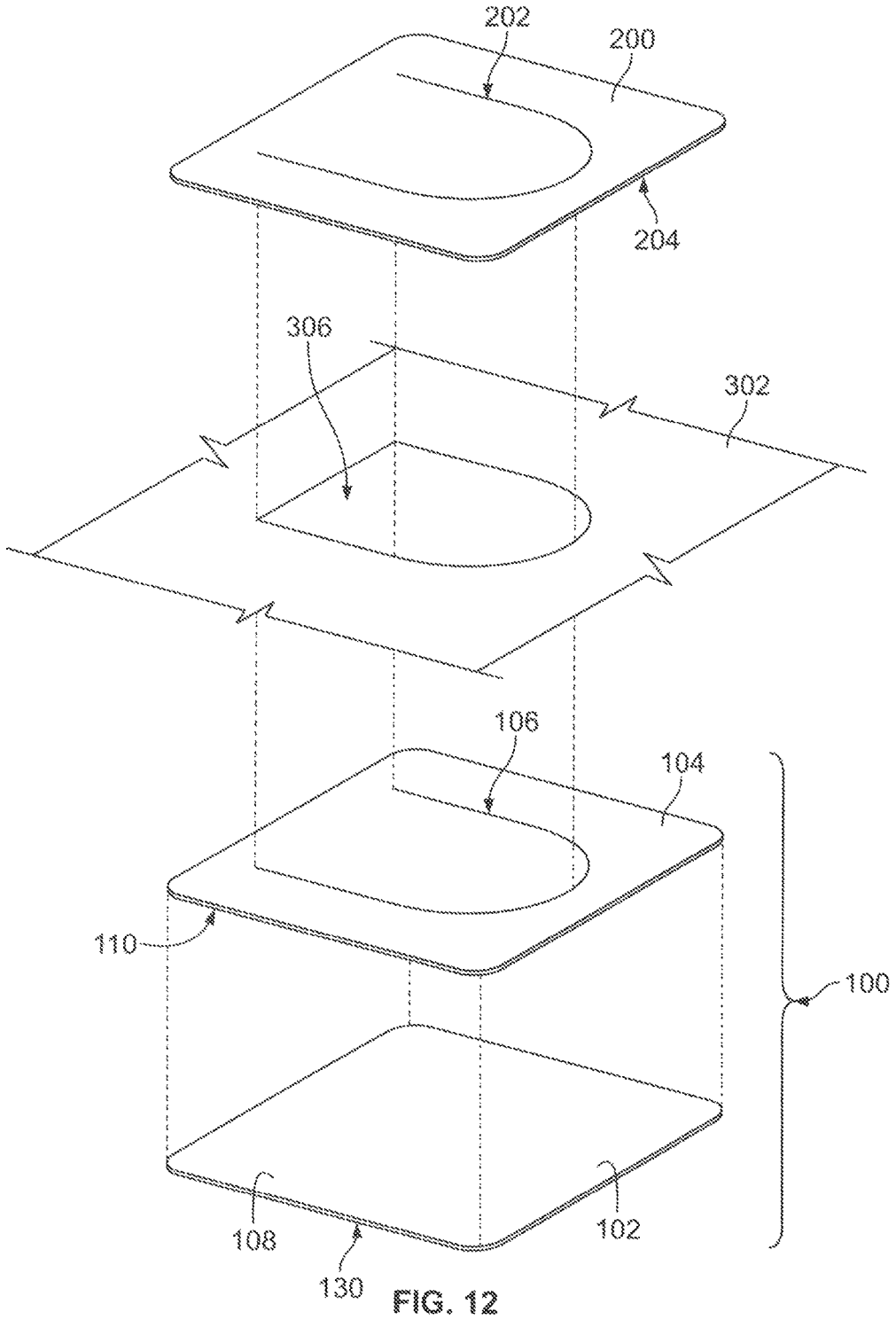
FIG. 12 shows an exploded perspective view of an embodiment of a resealable label and an inner label as applied to the exterior of a panel of a bag wall that has been perforated with a tombstone-shaped hole.

The label may be used in conjunction with a variety of containers, including bags. Among the types of bags for which the label may be used, both paper multi-layered and plastic bags are discussed herein. Where the resealable label is applied to a plastic bag, including single ply or multi-layered plastic bags, a perforation may be made in the wall of the bag such that the label adheres to a portion of the bag wall. Conversely, when the label is applied to a paper bag, including a multi-layered paper bag, an opening may be made in the bag wall complementary to the perforations of the resealable label and the inner label. These features can be seen in the variances in the application of the label to these two distinct types of bags can be seen in FIGS. 7 through 12. FIGS. 7 and 8 show cross-sectional views of the resealable label as applied to bag walls while the label is sealed, while FIGS. 9 and 10 show those same labels and bag walls when the label has been opened. Exploded views of the resealable label as applied to these types of bags are seen in FIGS. 11 and 12.

FIG. 7 shows the cross-sectional view along line A-A of FIG. 2, where both a resealable label 100 and an inner label 200 have been adhered to a panel 302 of a bag wall. In this embodiment, a portion of the bag wall 302 has been removed to permit the resealable label 100 and the inner label 202 to adhere to one another. The resealable label 100 includes both a top layer 102 and an inner layer 104. Regions of adhesive 108 and deadener 110 can be seen, relative to the perforation 106 of the bottom layer of the label. The inner label 200 has been adhered to the inside of the bag wall 302 and the resealable label 100 via an adhesive layer 204 on the inner label.

As previously discussed, the perforations of the resealable label 106 and the inner label 202 should be complementary in shape, though not necessarily in the same dimensions. This is illustrated in FIG. 7, where the gap between these two perforations forms a reclosure region 132. This same region can be seen in FIG. 1. In this way, the two labels 100, 200 form an adhesive label-to-label seal around the bag wall 302. Among other applications, this mechanism is suitable for use in multi-layered paper bags, where the contents of the bag might cause degradation of the bag wall material through repeated passage of the bag contents, which could be greasy foodstuffs.

FIG. 8 shows the cross-sectional view along line A-A of FIG. 2, where a resealable label 100 has been adhered to a panel of a bag wall 302 in the absence of an inner label, where the bag wall has merely been perforated in a shape complementary to the perforation of the resealable label. This application is distinct from that of FIG. 7, where a hole was made in the bag wall.

In this embodiment, both the top layer 102 and the bottom layer 104 of the resealable label can be seen, as well as the regions of adhesive 108 and adhesive 110 between the layers. An additional layer of adhesive has adhered the label 100 to the bag wall 302. The perforation 106 of the bottom layer 104 can be seen in relation to a perforation on the panel of the bag, where the gap between these two labels form a reclosure region 132.

FIG. 9 shows the cross-sectional view along line B-B of FIG. 1, where both a resealable label 100 and an inner label 200 have been adhered to a panel of a bag wall 302. In this way, FIG. 9 is an opened view of the arrangement seen in FIG. 7.

In this embodiment, where the resealable label 100 includes both a top layer 102 and a bottom layer 104, the label has been opened in an opening direction 400. When opened, the entire top layer 102 above the line (as seen in FIG. 3, for example, and as defined by the endpoints of the perforation of the bottom layer) may be pulled back in the opening direction 400 away from the bag wall 302. With the top layer of the label 102, also pulled back is a portion of the bottom layer 104, this portion bound by the concave region of the perforation above the line, as well as a portion of the inner label 200, this portion bound by the concave region of the perforation above the line. Adhesive 108 on the underside of the top layer 102 permits the re-openable reattachment of the top layer to the bottom layer 104, with the aid of the deadener 110. The region of deadener 206 of the inner label permits the re-openable reattachment of the bottom layer 104 to the inner label 200 in the reclosure region 132.

FIG. 10 shows the cross-sectional view along line B-B of FIG. 1, where a resealable label 100 has been adhered to a panel of a bag wall 302. In this way, FIG. 10 is an opened view of the arrangement seen in FIG. 8.

In this embodiment, where the resealable label 100 includes both a top layer 102 and a bottom layer 104, the label has been opened in an opening direction 400. When opened, the entire top layer 102 above the line (as seen in FIG. 3, for example, and as defined by the endpoints of the perforation of the bottom layer) may be pulled back in the opening direction 400 away from the bag wall 302. With the top layer of the label 102, also pulled back is a portion of the bottom layer 104, this portion bound by the concave region of the perforation above the line, as well as a portion of the bag wall 302. In this embodiment, no inner label is present, and the bag wall has been die cut or otherwise perforated. The perforation of the bag wall should be complementary in shape, though not necessarily in the same dimensions, to the perforation of the bottom layer of the resealable label, as can be further seen in subsequent figures.

FIG. 11 shows an exploded perspective view of an embodiment of a resealable label 100 and its layers 102, 104 as applied to the exterior of a panel 302 of a bag wall that has been perforated with a tombstone-shaped cut 304. FIG. 11 demonstrates an exploded view of the arrangement represented in the cross-sectional views of FIGS. 8 and 10, where no inner label is present. As previously discussed, the perforations 106, 304 of the bottom layer and the panel of the bag are complementary in shape. In this embodiment, both are U-shaped. However, in order to achieve the reclosure region 132 as seen in FIG. 8, the perforation 304 of the bag panel should be slightly smaller than the perforation 106 of the bottom layer.

Thus when the label is adhered to the surface of a bag via the adhesive on the bottom layer of the label, the bag wall perforation, which is complementary in shape to the perforation of the bottom layer of the label, is framed by the perforation of the bottom layer of the label. In this way, the line of the bottom layer of the label should align with a similar line formed by the endpoints of the perforation on the bag wall. This framing and alignment creates the desired reclosure region.

FIG. 12 shows an exploded perspective view of an embodiment of a resealable label 100 and an inner label 200 as applied to the exterior of a panel of a bag wall 302 that has been perforated with a tombstone-shaped hole 306. The top layer 102 and bottom layer 104 are both rounded squares that adhere to one another via the adhesive 108 and deadener 110 arrangement seen in prior figures. Similarly, the inner label 200 adheres to both the panel of the bag 302, as well as the bottom layer 104 of the resealable label 100 through the hole 306 on the panel of the bag. Though the perforations 106, 202 of the bottom layer of the resealable label and the inner label are complementary in shape, in order to achieve the reclosure region 132 as seen in FIG. 7, the perforation 202 of the inner label should be slightly smaller than the perforation 106 of the bottom layer. Additionally, in order to create an adhesive seal around the edges of the die cut hole 306 on the bag wall 302, that die cut hole should be larger than both the perforation 202 of the inner label and the perforation 106 of the bottom layer, as can be seen in FIGS. 7 and 9.

Thus a resealable label, acting as an outer label, and an inner label may both adhered to a bag wall to create a resealable label system. In this system, the bag wall has an interior side and an exterior side, and the bag wall has a hole complementary in shape to a perimeter formed by the perforation of the bottom layer of the outer label and the line between the endpoints of the perforation of the bottom layer. The hole has edges and is larger than the perimeter. In this system, the outer label is adhered to the exterior side of the bag wall via the adhesive on the bottom layer of the outer label, and the inner label is adhered to the interior side of the bag wall via the adhesive layer on the inner label. To align the labels and hole in the bag wall, the outer label and inner label are mounted on the bag wall such that the perforation of the inner label is framed by the perforation of the bottom layer of the label to create a reclosure region on the inner label, and the outer label and inner label are positioned on the bag wall hole such that the labels adhere to each other to create a label-to-label seal that encloses the edges of the hole. This is seen, for example, in FIG. 7.

Figure 13:
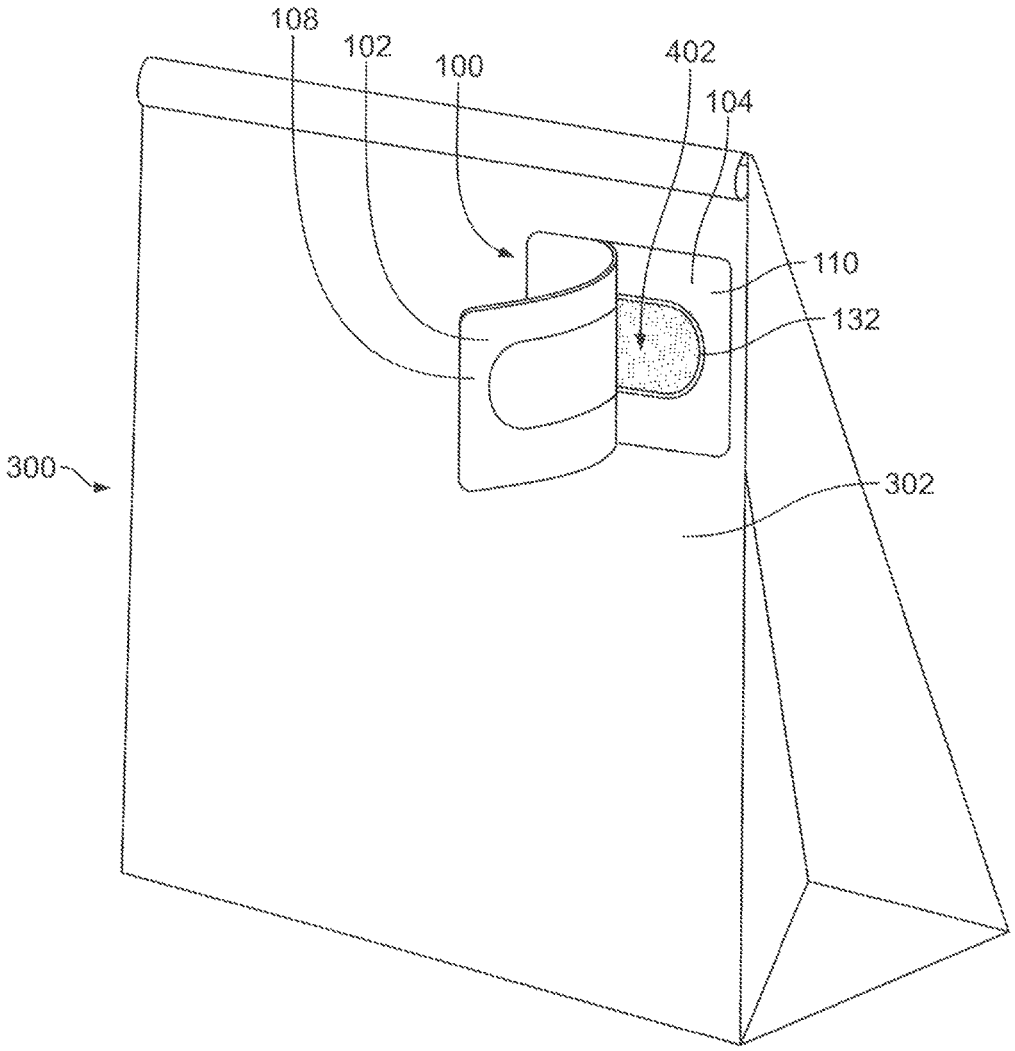
FIG. 13 shows an embodiment of a resealable label adhered to panel of a gusseted top-sealed bag wall, the label pulled back in an open position to grant access to the inside of the bag.

FIG. 13 shows an embodiment of a resealable label 100 adhered to panel 302 of a gusseted top-sealed bag 300, the label pulled back in an open position to grant access to the inside of the bag 402.

Figure 14:
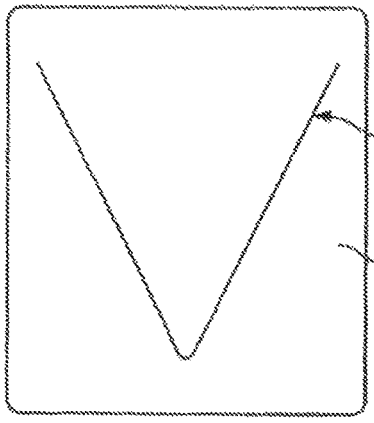
FIG. 14 shows an embodiment of the shape of the concave perforation of the resealable label, this shape being a V having a rounded bottom.
Figure 15:
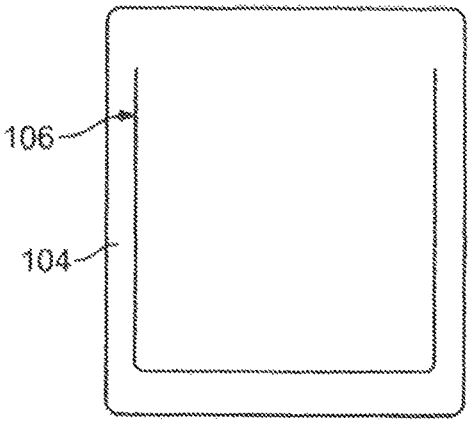
FIG. 15 shows another embodiment of the shape of the concave perforation of the resealable label, this shape being a rectangle having rounded corners.
Figure 16:
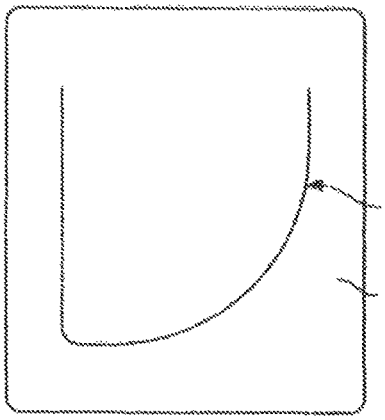
FIG. 16 shows yet another embodiment of the shape of the concave portion of the resealable label.
Figure 17:
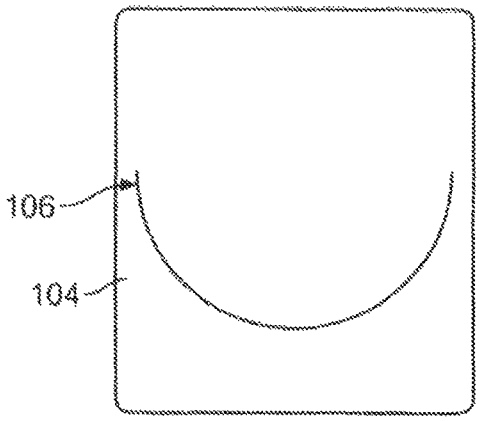
FIG. 17 shows another embodiment of the shape of the concave portion of the resealable label, this shape being a semicircle.

FIG. 14 shows an embodiment of the shape of the concave perforation 106 of the resealable label, this shape being a V having a rounded bottom. FIG. 15 shows another embodiment of the shape of the concave perforation of the resealable label, this shape being a rectangle having rounded corners. FIG. 16 shows yet another embodiment of the shape of the concave portion of the resealable label. FIG. 17 shows another embodiment of the shape of the concave portion of the resealable label, this shape being a semicircle. The various embodiments of FIGS. 14 through 17 and all others are embraced within the scope of this disclosure.

The top layer of the resealable label may itself be constructed of multiple layers. In an embodiment, the top layer includes a clear outer film ply adhered to a middle film ply. In this way, the clear ply may provide reinforcing strength to the label while providing a clear view of any printing that may be on the middle ply. As used herein, a middle ply refers to one or more ply of the resealable label between a clear outer ply and the bottom layer, where the middle ply and the outer ply make up the top layer.

In an embodiment, the outer film ply is a clear plastic film layer. The outer film ply may be, for example clear oriented polypropylene. In an embodiment, the middle ply is a white plastic film, for example white oriented polypropylene. The plastic film may include printing and/or be of any suitable color.

The bottom layer may also be constructed of multiple layers, analogous to the top layer. In an embodiment, the bottom layer is a single ply white oriented polypropylene, though any suitable film or layering of films may be used for the bottom layer.

When the resealable label is applied to plastic bags, such that no inner label is used in conjunction with the resealable label, the wall of the plastic bag may be die cut or otherwise perforated to create a perforation complementary to that of the resealable label. The resealable label may be applied to plastic bags in an in-line manufacturing process, either as a step during or subsequent to the construction of the plastic bags. The application of the resealable label should take care to line up the perforation of the bottom layer with the perforation on the panel of the bag to create the reclosure region seen in the Figures.

Where the resealable label is applied to paper bags, including multi-wall paper bags, an inner label may be used in conjunction with the resealable label, and the wall of the bag may be die cut or otherwise perforated to create a hole through the bag wall. The resealable label may be applied to paper bags in an in-line manufacturing process, either as a step during or subsequent to the construction of the paper bags. The application of the resealable label should take care to line up the perforation of the bottom layer with the perforation of the inner label to create the reclosure region seen in the Figures, and to seal off the cut edges of the hole on the bag panel via an adhesive seal between the inner label and the resealable label.

The inner label may be constructed of one or more ply. In an embodiment, the label may be a single ply clear oriented polypropylene film layer. Where applications call for the contents of the bag to be foodstuffs, it may be desirable for the inner label to be constructed of FDA compliant materials suitable for direct food contact.

In any application, where it is desirable for printing on the panel of the bag to remain visible even in the presence of a resealable label, each layer and ply of the resealable label may be clear. This may be achieved in a variety of ways known in the art, including the construction of the resealable label via clear oriented polypropylene and a clear adhesive.

Thus the disclosure includes a resealable label including a top layer and a bottom layer. The label has edges that define a shape of the label. The top layer is at least one ply the bottom layer is at least one ply. The top layer is adhered to the bottom layer via an adhesive layer therebetween. The bottom layer further includes a perforation having two endpoints, where the perforation is non-linear and includes both a concave side and a convex side. The label further includes a line defined by the endpoints of the perforation, the line extending beyond the endpoints and terminating at edges of the label. The label further includes a layer of deadener between the layers, the deadener being on the convex side of the perforation, and terminating at the line, where the deadener is at least some distance away from the perforation such that the deadener and the perforation do not abut. The label may further include a layer of adhesive on the bottom layer for adhering the label to a surface. In this way, the aforementioned layer of adhesive on the bottom layer is not between any layers of the label, but rather on the outermost side of the bottom layer to enable the label to be adhered to a surface.

For the purposes of this disclosure, non-linear is intended to mean and line that is not a straight line.

Any number or combination of gauge and thickness of films may be used to construct the resealable label and/or inner label.

When used in combination with an inner label, the resealable label of the disclosure may be referred to, for example, as the outer label.

Certain terminology is used herein for purposes of reference only, and thus is not intended to be limiting. For example, terms such as “upper”, “lower”, “above”, and “below” refer to directions in the drawings to which reference is made. Terms such as “front”, “back”, “rear”, “bottom” and “side”, describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms “first”, “second” and other such numerical terms referring to structures do not imply a sequence or order unless clearly indicated by the context.

When introducing elements or features and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention as well as all equivalents thereof.

What is claimed is:

1. A resealable label comprising a top layer and a bottom layer, the label having edges that define a shape of the label, where the top layer is at least one ply, and where the bottom layer is at least one ply, and the top layer is adhered to the bottom layer via an adhesive layer therebetween, wherein the bottom layer further comprises a perforation having two endpoints, where the perforation is non-linear and includes both a concave side and a convex side, the label further comprising a line defined by the endpoints of the perforation, the line extending beyond the endpoints and terminating at edges of the label, the label further comprising a layer of deadener between the layers, the deadener being on the convex side of the perforation out to the edges of the label and terminating at the line, where the deadener is at least some distance away from the perforation such that the deadener and the perforation do not abut, the label further comprising a layer of adhesive on the bottom layer for adhering the label to a surface, wherein the label is adhered to the surface of a bag via the adhesive on the bottom layer of the label, the bag comprising a bag wall having a perforation complementary in shape to the perforation of the bottom layer of the label, the perforation of the bag being smaller than the perforation of the bottom layer of the label, and wherein the label is mounted on the bag wall such that the perforation of the bag wall is framed by the perforation of the bottom layer of the label to create a reclosure region on the bag wall, the reclosure region being free of the deadener.

2. The resealable label of claim 1, wherein the top layer comprises two ply, the top layer having an outer plastic film layer adhered via an adhesive to a middle film layer of white oriented polypropylene, wherein the middle layer is adhered to the bottom layer.

3. The resealable label of claim 2, wherein the outer plastic film layer is clear oriented polypropylene.

4. The resealable label of claim 2, wherein the middle film layer further comprises printing that is visible through the outer film layer.

5. The resealable label of claim 2, the label further comprising a tamper evident mechanism.

6. The resealable label of claim 1, the label further comprising a tamper evident mechanism.

7. The resealable label of claim 6, wherein the tamper evident mechanism comprises two series of perforations on the label, a pull tab, and a deadener region, where the series of perforations comprise two linear substantially parallel series of incomplete perforations of the top layer of the label, the series of perforations being substantially parallel to the line defined by endpoints of the concave perforation, the series of perforations residing a distance away from and on the same side as the convex side of the concave perforation, where the pull tab comprises a protrusion of the top layer at an edge of the label generally centered at adjacent terminating ends of the series of perforations, and where the deadener region comprises a layer of deadener between the top layer and the bottom layer that covers an area defined by the two opposing side edges of the label where the series of perforations terminate, the deadener on the convex side of the perforation, and a line parallel to the series of perforations that is some distance from an edge of the label, as well as the area of the pull tab, such that the series of perforations and the area therebetween are separated from the bottom layer by the deadener region.

8. The resealable label of claim 6, wherein the top layer comprises two ply, the top layer having an outer plastic film layer adhered via an adhesive to a middle film layer of white oriented polypropylene, wherein the middle layer is adhered to the bottom layer.

9. The resealable label of claim 8, wherein the outer plastic film layer is clear oriented polypropylene.

10. The resealable label of claim 8, wherein the middle film layer further comprises printing that is visible through the outer film layer.

* * * * *